US005521689A

United States Patent [19]

Miyakoshi

[11] Patent Number: 5,521,689

[45] Date of Patent: May 28, 1996

[54] IMAGE FORMING APPARATUS WITH FLASH FIXING

[75] Inventor: Kunio Miyakoshi, Kawasaki, Japan

[73] Assignee: Fujitsu Limited, Kawasaki, Japan

[21] Appl. No.: 467,445

[22] Filed: Jun. 6, 1995

[30] Foreign Application Priority Data

Sep. 12, 1994 [JP] Japan ..... 6-217537

[51] Int. Cl.[6] ..... G03G 15/20

[52] U.S. Cl. ..... 355/288; 219/216

[58] Field of Search ..... 355/286, 288; 219/216

[56] References Cited

U.S. PATENT DOCUMENTS 3,832,524 8/1974 Takiguchi ..... 219/216

*Primary Examiner*—Joan H. Pendegrass
*Assistant Examiner*—Quana Grainger
*Attorney, Agent, or Firm*—Armstrong, Westerman, Hattori, McLeland & Naughton

[57] ABSTRACT

Disclosed is an image forming apparatus for forming an image on a sheet. The image forming apparatus comprises a unit for forming a toner image on the sheet and a flash fixing unit for fixing the toner image onto the sheet by an emission of light from a flash lamp. The flash fixing unit includes a first unit having a first flash lamp disposed at the center and a second unit having second flash lamps disposed on both sides of the first flash lamp and exhibiting a light emitting energy larger than a light emitting energy of the first unit. The second flash lamps disposed at a pitch smaller than the pitch at which the first lamps are disposed. With this construction, the fixing energies at both ends of the flash fixing unit increase, and the fixing energy at the center decreases. It is therefore possible to prevent an ill-fixed state and improve a fixing efficiency.

9 Claims, 13 Drawing Sheets

IMAGE FORMING APPARATUS WITH FLASH FIXING

BACKGROUND OF THE INVENTION

1. Field of the Invention

The present invention relates generally to an image forming apparatus including a flash fixing unit and, more particularly, to an image forming apparatus including a flash fixing unit with a uniformized fixing energy.

2. Description of the Related Art

A flash fixing method is known as a method capable of performing non-contact fixing in an electrophotographic apparatus. The flash fixing method is capable of fixing a toner image onto a sheet at a high speed and is therefore utilized in the high-speed electrophotographic apparatus. According to this flash fixing method, if a sheet feeding speed is low, a single piece of flash lamp may be enough for the fixing. Whereas if the sheet feeding speed is high, however, three or more flash lamps are needed as the case may be.

FIG. 13 is an explanatory diagram showing the prior art.

As illustrated in FIG. 13, four pieces of flash lamps 90-1 through 90-4 are arranged in parallel to a sheet 92. These flash lamps 90-1 to 90-4 are covered with a reflection plate 91.

The flash lamps 90-1 to 90-4 flash at a constant interval. The sheet is consecutively fed corresponding thereto. Accordingly, an area where the flash lamps effect the fixing at one time varies depending on the number of the flash lamps installed. For this reason, if the sheet feeding speed increases, the one-time fixing area expands. This requires a plurality of flash lamps.

In such a conventional flash fixing unit using the three or more flash lamps, the respective flash lamps 90-1 to 90-4 flash under the same conditions. More specifically, input energies (input voltages) of the flash lamps 90-1 to 90-4 are the same, and installation intervals of the flash lamps 90-1 to 90-4 are made constant.

According to the prior art, however, first, the three or more flash lamps flash under the same conditions, and, hence, as illustrated in FIG. 13, a fixing energy distribution thereof rises in the vicinity of central portion but is lowered at both ends. Therefore, an ill-fixed state is easy to occur at both ends of a fixing area. This results in a ununiformity in terms of the fixing.

Second, the center of the fixing energy distribution is higher than an energy needed for the fixing, and hence there is caused a drop in fixing efficiency.

SUMMARY OF THE INVENTION

It is a primary object of the present invention to provide an image forming apparatus for preventing an ill-fixed state.

It is another object of the present invention to provide an image forming apparatus for performing stable fixing by uniformizing a fixing energy distribution of three or more flash lamps.

It is still another object of the present invention to provide an image forming apparatus for improving a fixing efficiency.

It is a further object of the present invention to provide an image forming apparatus to provide an image forming apparatus for preventing the ill-fixed state and improving the fixing efficiency by a simple method.

To accomplish the objects given above, according to one aspect of the present invention, an image forming apparatus for forming an image on a sheet comprises a unit for forming a toner image on the sheet and a flash fixing unit for fixing a toner image onto the sheet by an emission of light from a flash lamp. The flash fixing unit includes a first unit having a first flash lamp disposed at the center and a second unit having second flash lamps disposed on both sides of the first flash lamp and exhibiting a light emitting energy larger than a light emitting energy of the first unit.

According to another aspect of the present invention, the flash fixing unit includes a first unit having first flash lamps disposed at the center and at a predetermined pitch between the first flash lamps and a second unit having second flash lamps disposed on both sides of the first flash lamps and at a pitch smaller than the pitch at which the first lamps are disposed.

According to the present invention, the fixing energy of each of the flash lamps disposed at both ends is set larger than the fixing energy of the flash lamp disposed at the center. With this arrangement, the fixing energy at the center of the fixing energy distribution is lowered, whereas the energies at both ends rise. The fixing energy distribution is therefore uniformized. Accordingly, it is possible to prevent the ill-fixed state and improve the fixing efficiency.

Other features and advantages of the present invention will become readily apparent from the following description taken in conjunction with the accompanying drawings.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principle of the invention, in which.

DETAILED DESCRIPTION OF THE PREFERRED EMBODIMENTS

Figure 1:
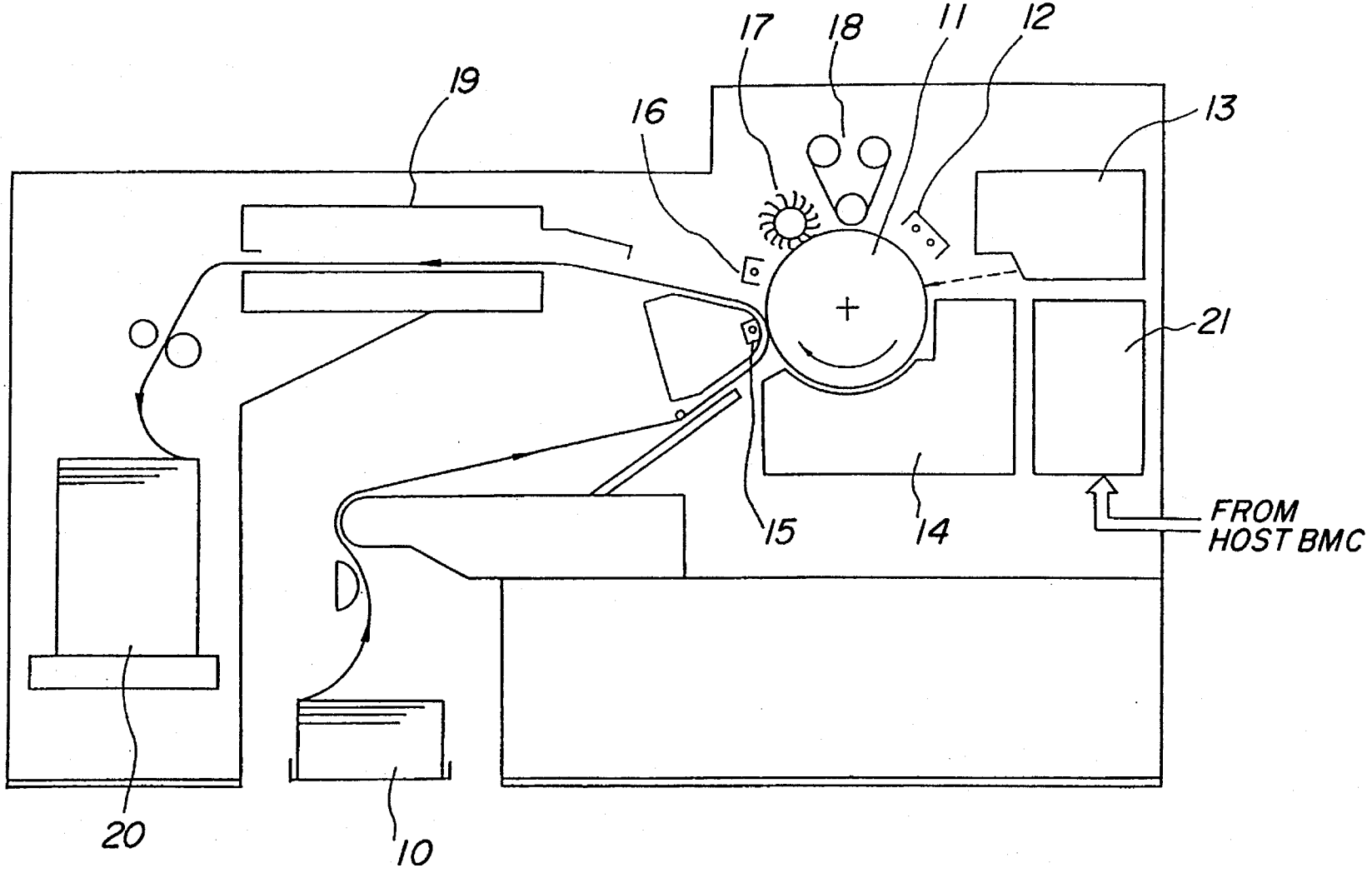
FIG. 1 is a view illustrating a construction of a printing apparatus in accordance with one embodiment of the present invention.

FIG. 1 is a view illustrating a construction of a printing apparatus in one embodiment of the present invention.

As illustrated in FIG. 1, consecutive sheets within a hopper 10 are consecutively fed. These consecutive sheets are stacked in a stacker 20 through a transfer charger 15 and a flash fixing unit 19. A photosensitive drum 11 rotating clockwise is uniformly charged by a precharger 12, and, thereafter, an image is exposed by a laser optical system 13. An electrostatic latent image corresponding to the image is thereby formed on the photosensitive drum 11. Image data from a host are stored in a buffer 21. The laser optical system 13 is driven based on this item of image data. The laser optical system 13 forms an exposure image.

The electrostatic latent image on the photosensitive drum 11 is developed by a developing unit 14, and thereafter a toner image on the photosensitive drum 11 is transferred onto the consecutive sheet by the transfer charger 15. The photosensitive drum 11 is, after effecting this transfer, de-electrified by a de-electrifier 16, and the surface thereof is cleaned by a cleaner 17 and a fleece 18.

The consecutive sheet undergoing the transfer of the toner image is flash-fixed by the flash fixing unit 19 and thereafter stacked in the stacker 20. Note that a mechanism for forming the toner image on the sheet is constructed of the photosensitive drum 11, the precharger 12, the laser optical system 13, the developing unit 14, the transfer charger 15, the de-electrifier 16, the cleaner 17 and the fleece 18.

Figure 2:
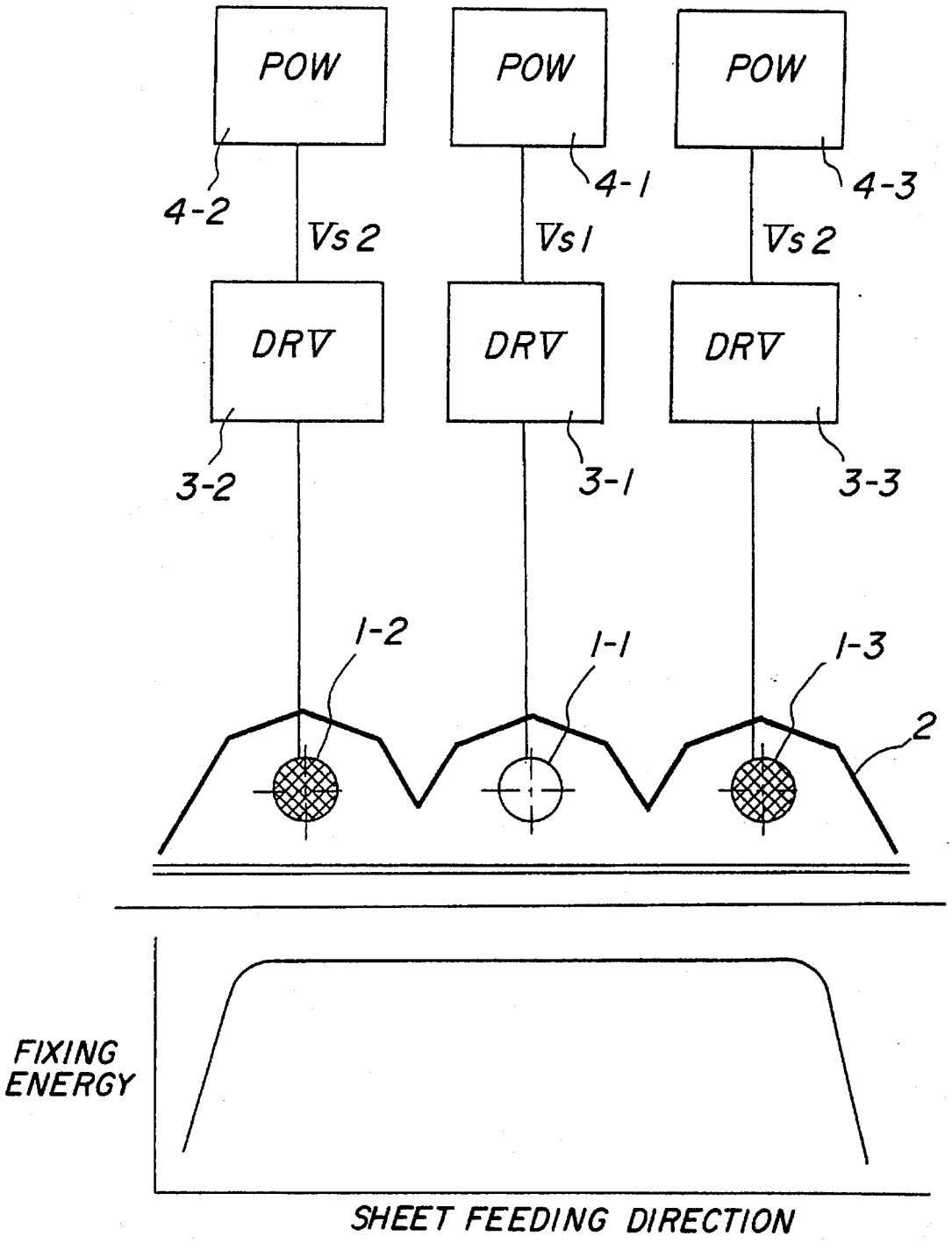
FIG. 2 is an explanatory diagram showing one embodiment of the present invention.
Figure 3:
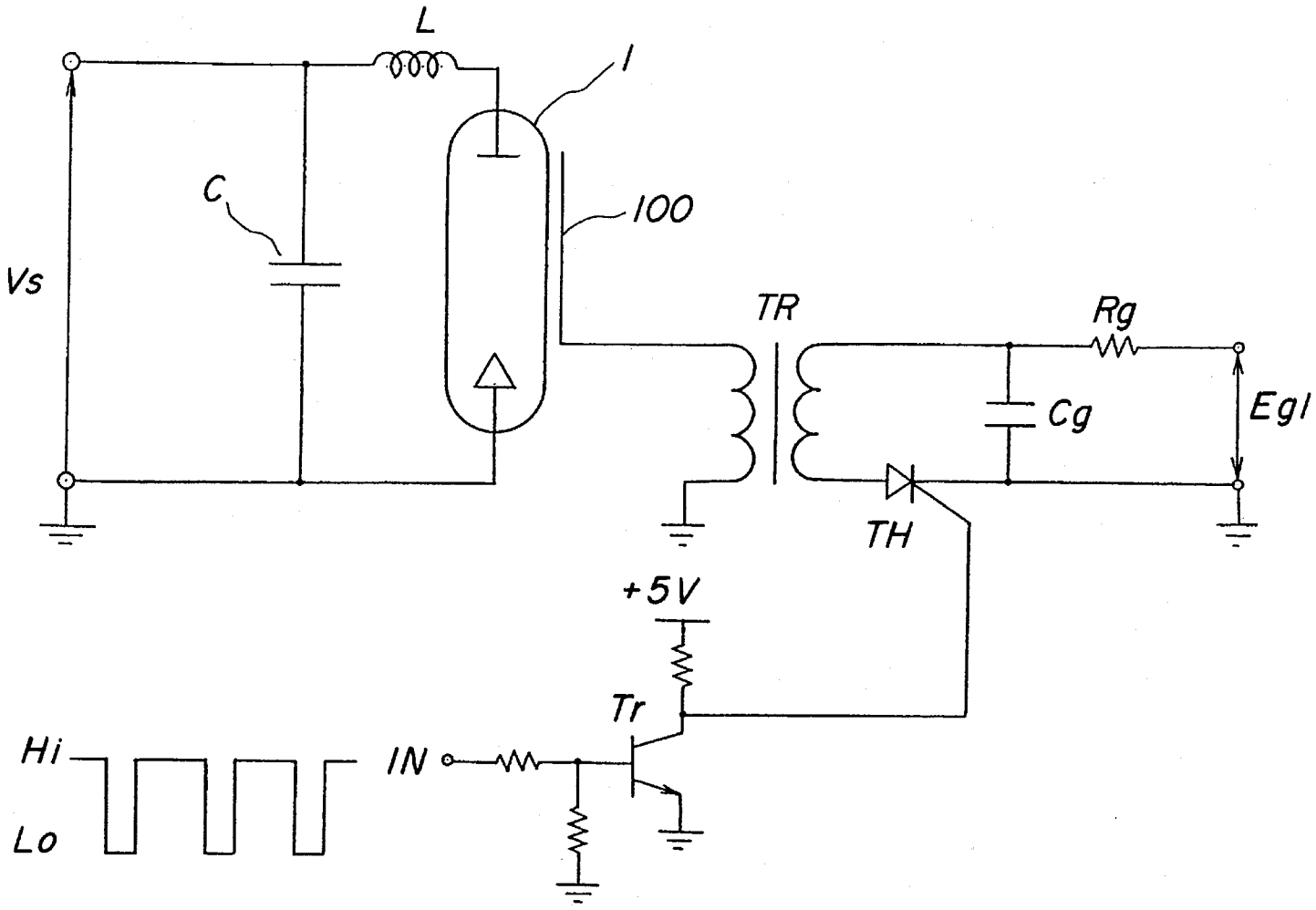
FIG. 3 is a diagram showing a structure of a drive circuit of FIG. 2.

FIG. 2 is an explanatory diagram showing one embodiment of the present invention. FIG. 3 is a view illustrating a configuration of a drive circuit of FIG. 2.

As shown in FIG. 2, three pieces of flash lamps 1-1 to 1-3 are arranged in parallel to the sheet. Provided is a reflection plate 2 for covering these flash lamps 1-1 through 1-3. The three flash lamps are spaced away from each other at an interval of 40–50 mm.

The flash lamps 1-1 to 1-3 are respectively provided with drive circuits 3-1 to 3-3 and power supplies 4-1 to 4-3. The drive circuits 3-1 to 3-3 and the power supplies 4-1 to 4-3 serve as energy sources.

A supply voltage Vs2 from each of the power supplies 4-2, 4-3 is set higher than a supply voltage Vs1 from the power supply 4-1. Accordingly, the high voltages Vs2 are applied to the flash lamps 1-2, 1-3 disposed at both ends through the respective drive circuits 3-2, 3-3. On the other hand, the low voltage Vs1 is applied to the central flash lamp 1-1 through the drive circuit 3-1.

For this reason, light emitting energies of the flash lamps 1-2, 1-3 at both ends are large, whereas the light emitting energy of the central flash lamp 1-1 is small. That is, fixing energies given by the flash lamps 1-2, 1-3 at both ends are large, whereas the fixing energy given by the central flash lamp 1-1 is small. Consequently, a distribution of the fixing energies of all the flash lamps 1-1 to 1-3 is, as illustrated in FIG. 2, uniformized. That is, the fixing energy becomes greater at both ends but smaller in the middle than in the prior art.

Therefore, the futile fixing energy in the middle of the flash fixing unit decreases, and, besides, the fixing energies at both ends increase. It is therefore possible to prevent an ill-fixed state at both ends of the flash fixing unit. Further, the futile fixing energy in the middle of the flash fixing unit can be reduced. Accordingly, a fixing ununiformity can be prevented, and, besides, a fixing efficiency can be improved.

In this example, an input energy ($=\frac{1}{2}CV^2$) of the central flash lamp 1-1 is set to 200–400 Joul. Then, the input energy of each of the flash lamps 1-2, 1-3 at both ends is set 1.3 times as large as the former input energy. Preferably, an input energy $\epsilon_1$ of each of the flash lamps 1-2, 1-3 at both ends with respect to the an input energy $\epsilon$ of the middle central lamp 1-1 falls within a range of $\epsilon<\epsilon_1\leqq 1.3\times\epsilon$.

Setting the supply voltages to the power supplies 4-1 through 4-3 can be easily actualized by adjusting the voltages of the power supplies 4-1 to 4-3.

In accordance with this embodiment, the above actualization is done by changing not light emitting capacities of the flash lamps 1-1 through 1-3 but the supply voltages. Therefore, the above setting can be readily actualized by use of the flash lamp having one kind of light emitting capacity.

Next, the drive circuit will be explained with reference to FIG. 3. As illustrated in FIG. 3, a supply voltage Vs is applied from the power supply to both ends of the flash lamp 1 (1-1 through 1-3). A charging/discharging capacitor C is provided in parallel to the flash lamp 1. Further, an inductance element L is provided at one end of the flash lamp 1.

On the other hand, a drive signal IN is inputted to a base of a transistor Tr. A collector of this transistor Tr is connected to a gate of a thyristor TH. The thyristor TH is connected to a transformer Tr. This transformer TR is connected to a trigger electrode 100 of the flash lamp 1.

Accordingly, the transistor Tr is kept ON, whereas the thyristor TH is kept OFF during a high-level of the drive signal IN. For this reason, no electric current flows to the trigger electrode 100 of the flash lamp 1. Hence, the charging/discharging capacitor C is charged by the supply voltage Vs.

Reversely when the drive signal IN assumes a low level, the transistor Tr is turned OFF, and, therefore, the thyristor TR is turned ON. With this operation, the electric current flows to the trigger electrode 100 of the flash lamp 1 via the transformer TR. Consequently, the flash lamp 1 is driven by the charging voltage of the charging/discharging capacitor C and thereby emits the light.

This drive signal IN periodically repeatedly takes the high and low levels, and hence the flash lamp 1 periodically emits the light.

Thus, the light emitting energies of the flash lamps 1-2, 1-3 at both ends are increased, whereas the light emitting energy of the central flash lamp 1-1 is reduced. It is therefore possible to uniformize the fixing energy distribution of the flash fixing unit. Besides, this can be easily actualized by use of the flash lamp having one kind of light emitting capacity.

Figure 4:
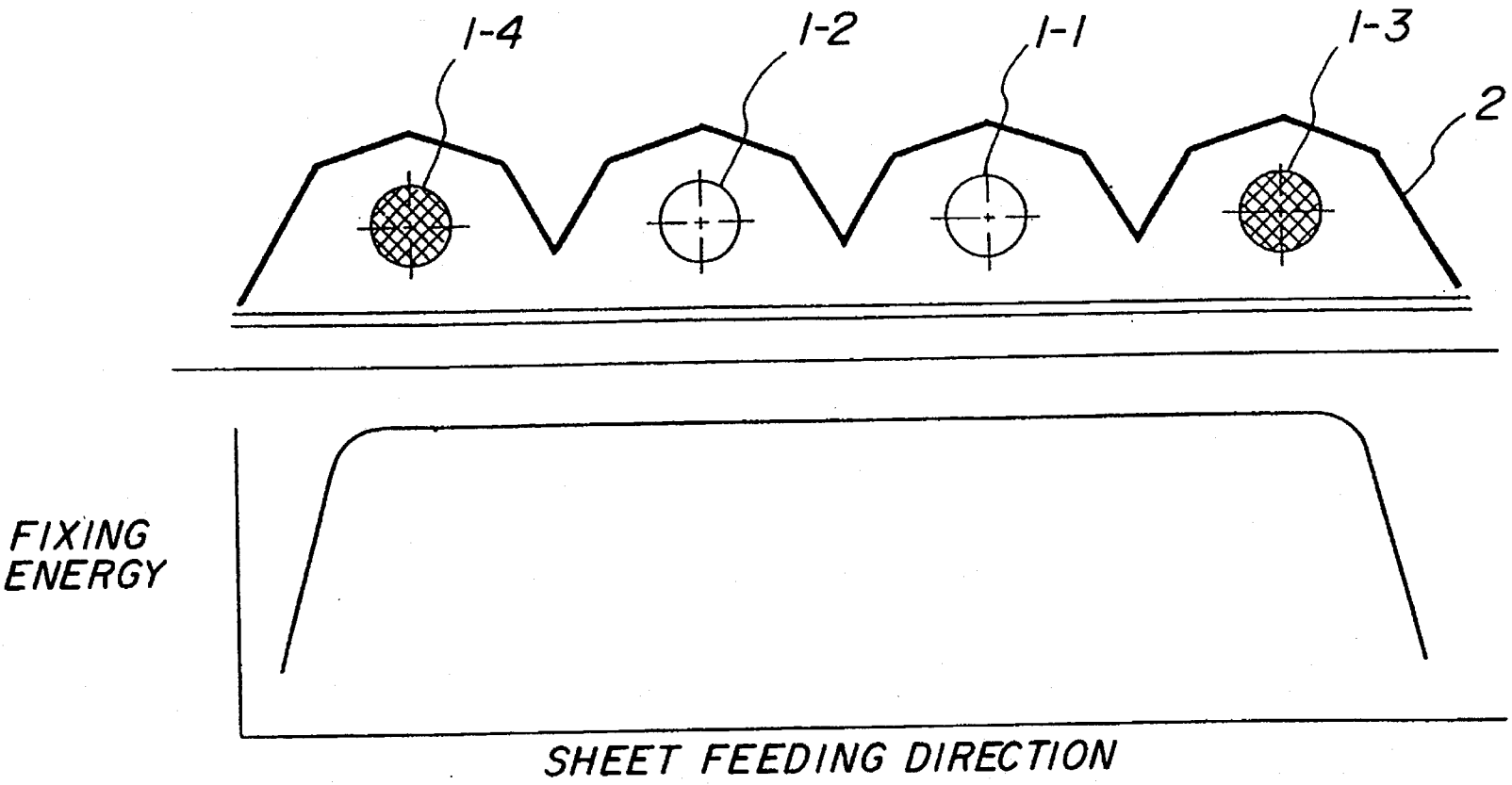
FIG. 4 is an explanatory diagram Illustrating a first modified example of the present invention.

FIG. 4 is an explanatory diagram showing a first modified example according to this invention.

As depicted in FIG. 4, four pieces of flash lamps 1-1 through 1-4 are arranged in parallel to the sheet. Provided also is the reflection plate 2 for covering these flash lamps 1-1 through 1-4.

The flash lamps 1-1 to 1-4 are respectively provided with unillustrated drive circuits and power supplies. The supply voltage Vs2 from each of the power supplies of the flash lamps 1-3, 1-4 at both ends is set higher than the supply voltage Vs1 from each of the power supplies of the middle flash lamps 1-1, 1-2.

Accordingly, the light emitting energies of the flash lamps 1-3, 1-4 at both ends increase, whereas the light emitting energies of the middle flash lamps 1-1. 1-2 decrease. The fixing energy distribution of all the flash lamps 1-1 through 1-4 is, as illustrated in FIG. 4, thereby uniformized. That is, the fixing energy becomes greater at both ends but smaller in the middle than in the prior art.

Therefore, the futile fixing energy in the middle of the flash fixing unit decreases, and, besides, the fixing energies at both ends increase. It is therefore possible to prevent the ill-fixed state at both ends of the flash fixing unit. Further, the futile fixing energy in the middle of the flash fixing unit can be reduced. Accordingly, the fixing ununiformity can be prevented, and, besides, the fixing efficiency can be improved.

Figure 5:
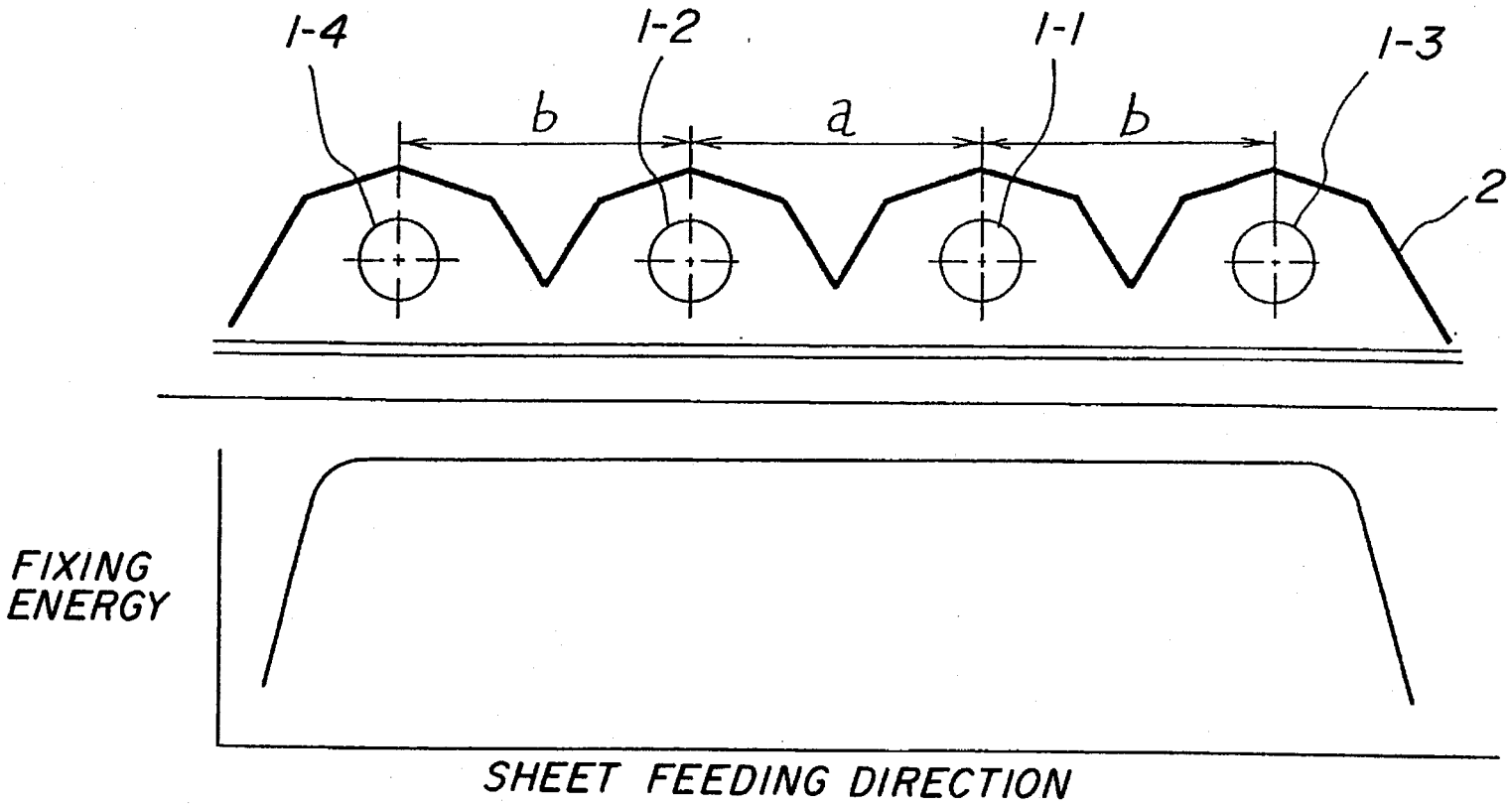
FIG. 5 is an explanatory diagram illustrating a second modified example of the present invention.

In this example, the input energy $\epsilon_1$ of each of the flash lamps 1-3, 1-4 at both ends is set within the range of $\epsilon<\epsilon_1\leqq 1.3\times\epsilon$ with respect to the input energy $\epsilon$=200–400 Joul of each of the middle flash lamps 1-1, 1-2. FIG. 5 is an explanatory diagram showing a second modified example according to this invention.

As depicted in FIG. 5, four pieces of flash lamps 1-1 through 1-4 are arranged in parallel to the sheet. Provided also is the reflection plate 2 for covering these flash lamps 1-1 through 1-4.

The supply voltage inputted to each of the flash lamps 1-1 through 1-4 is fixed. A lamp-to-lamp pitch b between the flash lamps 1-3, 1-4 at both ends and the lamps adjacent thereto is, however, set smaller than a lamp-to-lamp pitch a between the middle flash lamps 1-1, 1-2.

The fixing energies of the flash lamps 1-3, 1-4 at both ends thereby increase. Accordingly, the fixing energy distribution of all the flash lamps 1-1 through 1-4 is, as illustrated in FIG. 5, more uniformized. That is, the fixing energy becomes greater at both ends but smaller in the middle than in the prior art.

Therefore, the futile fixing energy in the middle of the flash fixing unit decreases, and, besides, the fixing energies at both ends increase. It is therefore possible to prevent the ill-fixed state at both ends of the flash fixing unit. Further, the futile fixing energy in the middle of the flash fixing unit can be reduced. Accordingly, the fixing ununiformity can be prevented, and, besides, the fixing efficiency can be improved.

In this example, the lamp-to-lamp pitch a between the middle flash lamps 1-1, 1-2 is set such as a=40 mm–50 mm. Then, the lamp-to-lamp pitch with respect to the flash lamps 1-3, 1-4 at both ends is set to a/1.3.

It is proper that the lamp-to-lamp pitch b with respect to the flash lamps 1-3, 1-4 at both ends falls within a range of $1/1.3\leqq b<a$ in relation to the lamp-to-lamp pitch a between the middle flash lamps.

This embodiment can be readily actualized simply by changing the installation interval between the flash lamps.

Figure 6:
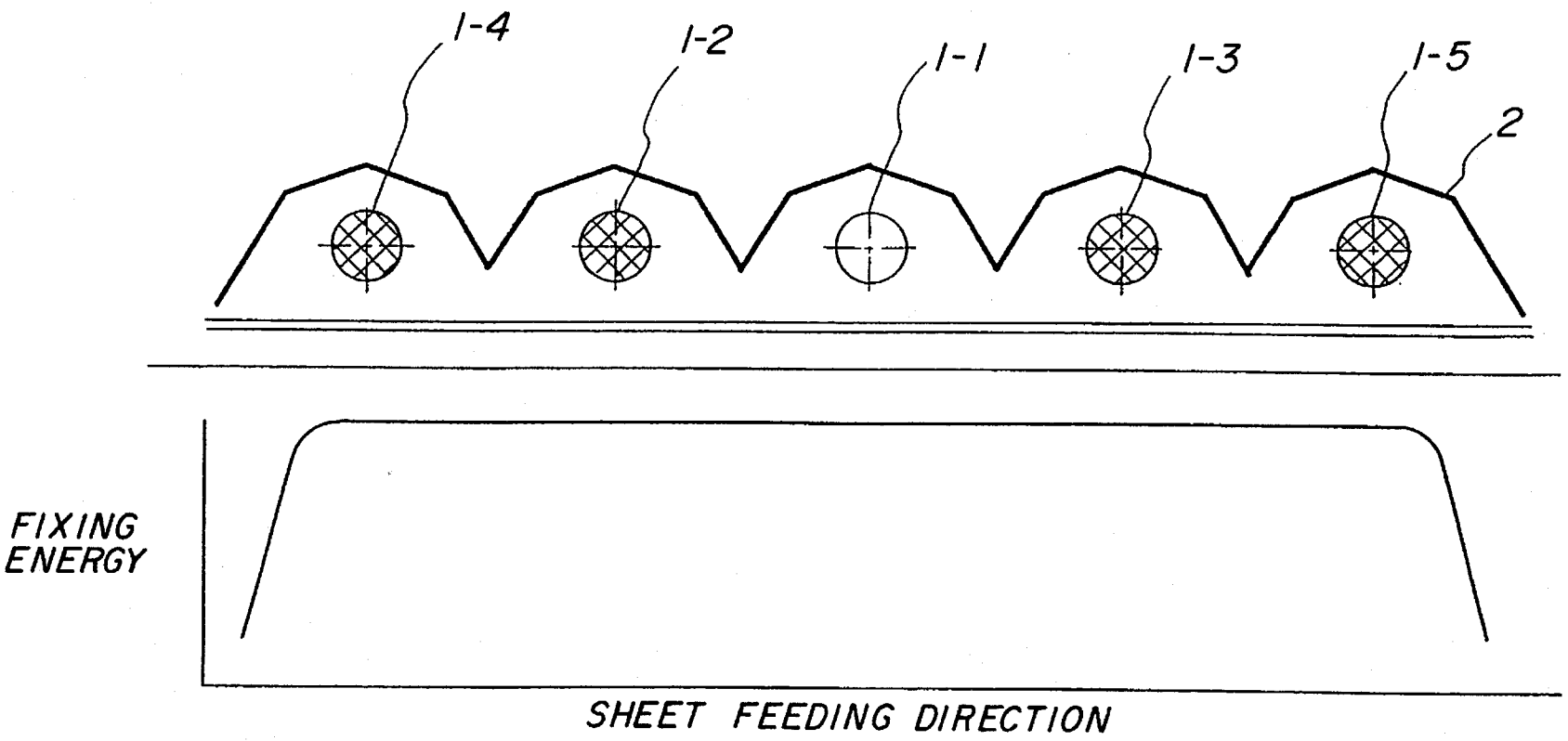
FIG. 6 is an explanatory diagram illustrating a third modified example of the present invention.

FIG. 6 is an explanatory diagram showing a third modified example according to this invention.

As depicted in FIG. 6, five pieces of flash lamps 1-1 through 1-5 are arranged in parallel to the sheet. Provided also is the reflection plate 2 for covering these flash lamps 1-1 through 1-5.

The flash lamps 1-1 to 1-5 are respectively provided with unillustrated drive circuits and power supplies. The supply voltage Vs2 from each of the power supplies of the four flash lamps 1-2, 1-3, 1-4, 1-5 disposed at both ends is set higher than the supply voltage Vs1 of the power supply of the central flash lamp 1-1.

Accordingly, the light emitting energies of the flash lamps 1-2, 1-3, 1-4, 1-5 at both ends increase, whereas the light emitting energy of the central flash lamp 1-1 decreases. The fixing energy distribution of all the flash lamps 1-1 through 1-5 is, as illustrated in FIG. 6, thereby more uniformized. That is, the fixing energy becomes greater at both ends but smaller in the middle than in the prior art.

Therefore, the futile fixing energy in the middle of the flash fixing unit decreases, and, besides, the fixing energies at both ends increase. It is therefore possible to prevent the ill-fixed state at both ends of the flash fixing unit. Further, the futile fixing energy in the middle of the flash fixing unit can be reduced. Accordingly, the fixing ununiformity can be prevented, and, besides, the fixing efficiency can be improved.

In this example, the input energy $\epsilon_1$ of each of the flash lamps 1-2 through 1-5 at both ends is set within the range of $\epsilon<\epsilon_1\leqq 1.3\times\epsilon$ with respect to the input energy $\epsilon$ (=200–400 Joul) of the central flash lamp 1-1.

Figure 7:
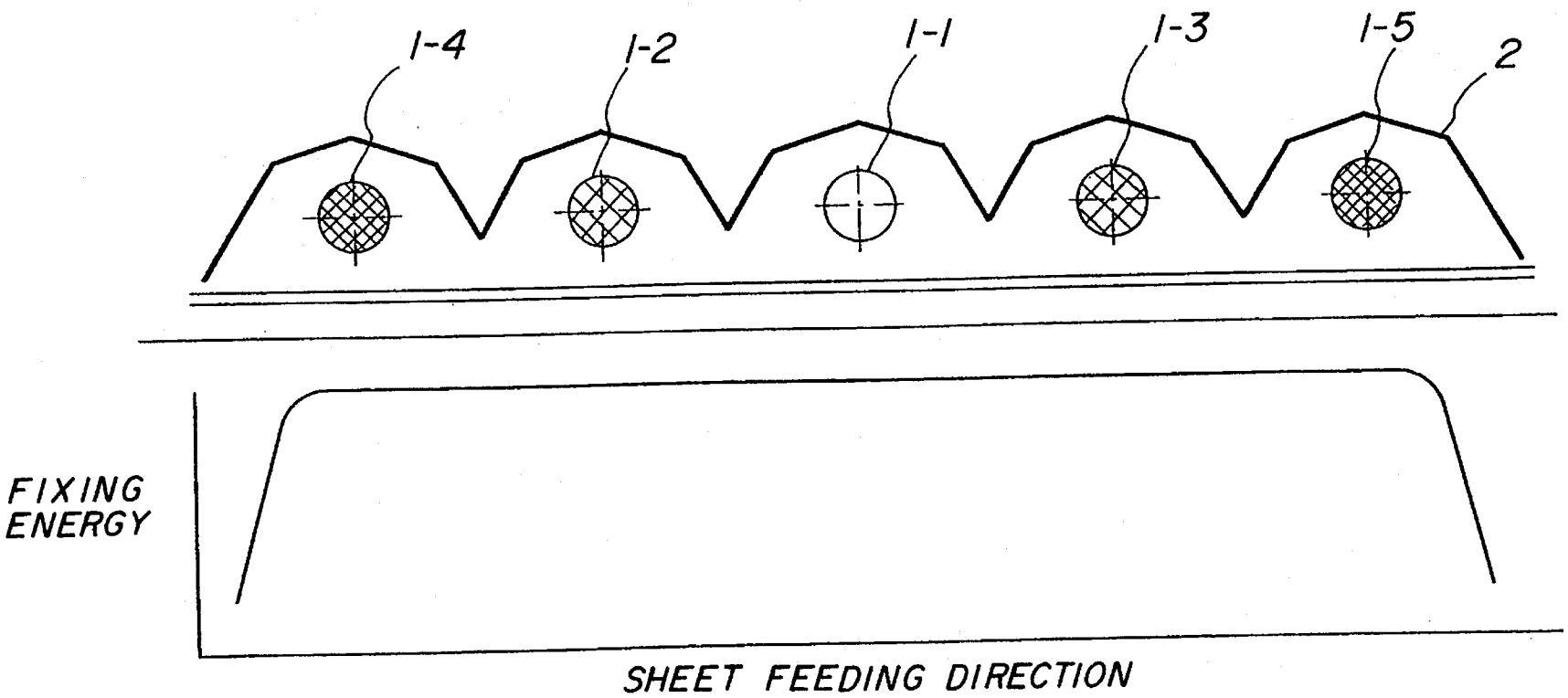
FIG. 7 is an explanatory diagram illustrating a fourth modified example of the present invention.

FIG. 7 is an explanatory diagram showing a fourth modified example according to this invention.

As illustrated in FIG. 7, five pieces of flash lamps 1-1 through 1-5 are arranged in parallel to the sheet. Provided also is the reflection plate 2 for covering these flash lamps 1-1 through 1-5.

The flash lamps 1-1 to 1-5 are respectively provided with unillustrated drive circuits and power supplies. The supply voltage Vs2 of each of the power supplies of the flash lamps 1-2, 1-3 adjacent to the central flash lamp 1-1 is set higher than the supply voltage Vs1 of the power supply of the central flash lamps 1-1. Further, a supply voltage Vs3 of each power supply of the two flash lamps 1-4, 1-5 at both ends is set higher than the supply voltage Vs2 of each power supply of the adjacent flash lamps 1-2, 1-3.

Accordingly, the flash lamps 1-4, 1-5 at both ends have the maximum light emitting energy; the flash lamps 1-2, 1-3 adjacent thereto have the intermediate light emitting energy; and the central flash lamp 1-1 has the minimum light emitting energy. The fixing energy distribution of all the flash lamps 1-1 through 1-5 is, as illustrated in FIG. 7, thereby more uniformized. That is, the fixing energy becomes greater at both ends but smaller in the middle than in the prior art.

Therefore, the futile fixing energy in the middle of the flash fixing unit decreases, and, besides, the fixing energies at both ends increase. It is therefore possible to prevent the ill-fixed state at both ends of the flash fixing unit. Further, the futile fixing energy in the middle of the flash fixing unit can be reduced. Accordingly, the fixing ununiformity can be prevented, and, besides, the fixing efficiency can be improved.

In this example, the input energy $\epsilon_1$ of each of the two adjacent flash lamps 1-2, 1-3 is set within the range of $\epsilon<\epsilon_1\leqq 1.3\times\epsilon$ with respect to the input energy $\epsilon$(=200–400 Joul) of the central flash lamp 1-1. Moreover, an input energy $\epsilon_2$ of each of the two adjacent flash lamps 1-4, 1-5 is set within a range of $\epsilon_1<\epsilon_2\leqq 1.3\times\epsilon_1$.

Figure 8:
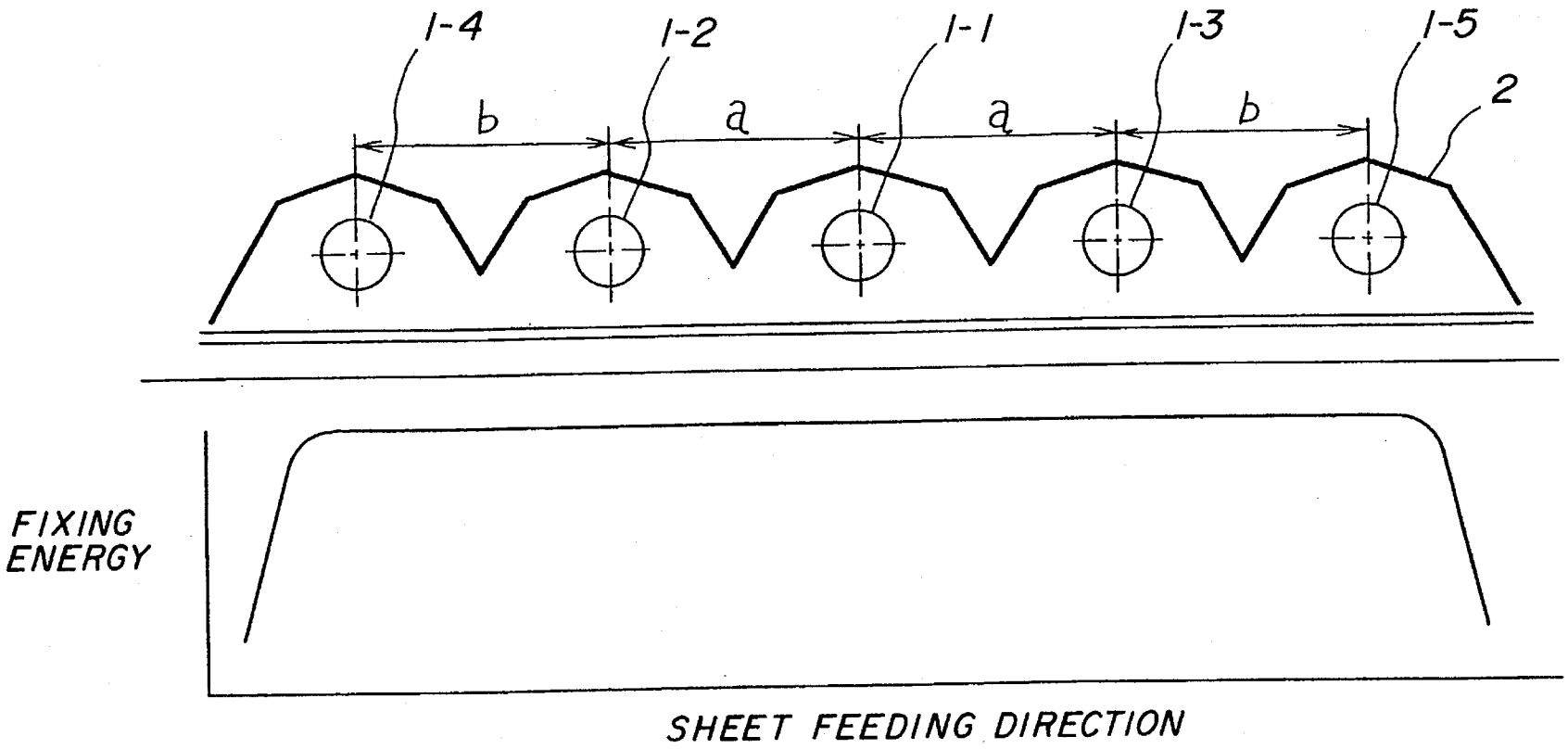
FIG. 8 is an explanatory diagram illustrating a fifth modified example of the present invention.

FIG. 8 is an explanatory diagram showing a fifth modified example according to this invention.

As illustrated in FIG. 8, five pieces of flash lamps 1-1 through 1-5 are arranged in parallel to the sheet. Provided also is the reflection plate 2 for covering these flash lamps 1-1 through 1-5.

The supply voltage inputted to each of the flash lamps 1-1 through 1-5 is fixed. The lamp-to-lamp pitch b between the flash lamps 1-4, 1-5 at both ends and the flash lamps adjacent thereto is, however, is set smaller than the lamp-to-lamp pitch a between the middle flash lamps 1-1, 1-2, 1-3.

The fixing energies of the flash lamps 1-4, 1-5 at both ends thereby increase. Accordingly, the fixing energy distribution of all the flash lamps 1-1 through 1-5 is, as illustrated in FIG. 8, thereby more uniformized. That is, the fixing energy becomes greater at both ends but smaller in the middle than in the prior art.

Therefore, the futile fixing energy in the middle of the flash fixing unit decreases, and, besides, the fixing energies at both ends increase. It is therefore possible to prevent the ill-fixed state at both ends of the flash fixing unit. Further, the futile fixing energy in the middle of the flash fixing unit can be reduced. Accordingly, the fixing ununiformity can be prevented, and, besides, the fixing efficiency can be improved.

In this example, the lamp-to-lamp pitch a between the middle flash lamps 1-1, 1-2, 1-3 is set to 40–50 mm. Further, the lamp-to-lamp pitch b with respect to the flash lamps 1-4, 1-5 at both ends is set to $a/1.3 \leqq < a$.

Figure 9:
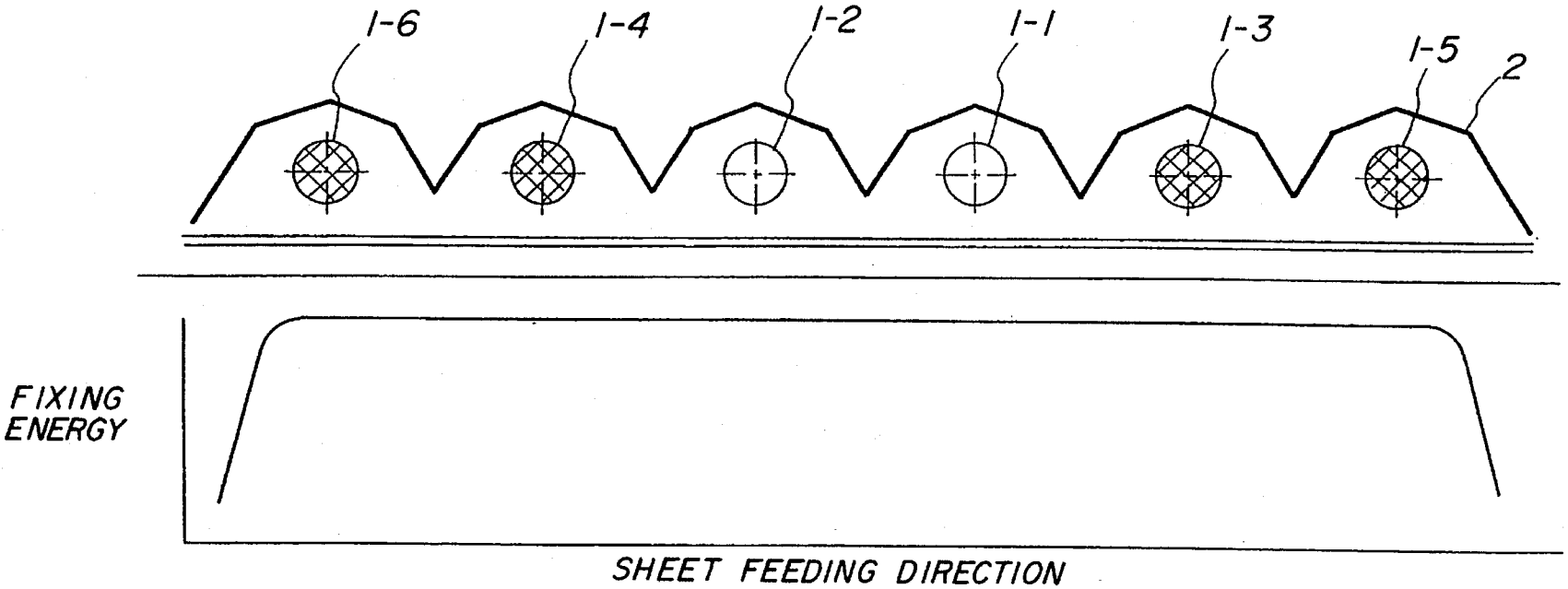
FIG. 9 is an explanatory diagram illustrating a sixth modified example of the present invention.

FIG. 9 is an explanatory diagram showing a sixth modified example according to this invention.

As depicted in FIG. 9, six pieces of flash lamps 1-1 through 1-6 are arranged in parallel to the sheet. Provided also is the reflection plate 2 for covering these flash lamps 1-1 through 1-6.

The flash lamps 1-1 to 1-6 are respectively provided with unillustrated drive circuits and power supplies. The supply voltage Vs2 from each power supply of the four flash lamps 1-3, 1-4, 1-5, 1-6 disposed at both ends is set higher than the supply voltage Vs1 of each power supply of the two middle flash lamps 1-1, 1-2.

Accordingly, the light emitting energies of the flash lamps 1-3, 1-4, 1-5, 1-6 at both ends increase, whereas the light emitting energies of the middle flash lamps 1-1, 1-2 decreases. The fixing energy distribution of all the flash lamps 1-1 through 1-6 is, as illustrated in FIG. 9, thereby more uniformized. That is, the fixing energy becomes greater at both ends but smaller in the middle than in the prior art.

Therefore, the futile fixing energy in the middle of the flash fixing unit decreases, and, besides, the fixing energies at both ends increase. It is therefore possible to prevent the ill-fixed state at both ends of the flash fixing unit. Further, the futile fixing energy in the middle of the flash fixing unit can be reduced. Accordingly, the fixing ununiformity can be prevented, and, besides, the fixing efficiency can be improved.

In this example, the input energy $\epsilon_1$ of each of the adjacent four flash lamps 1-3, 1-4, 1-5, 1-6 is set within the range of $\epsilon < \epsilon_1 \leqq 1.3 \times \epsilon$ with respect to the input energy $\epsilon$ (=200–400 Joul) of the middle flash lamps 1-1, 1-2.

Figure 10:
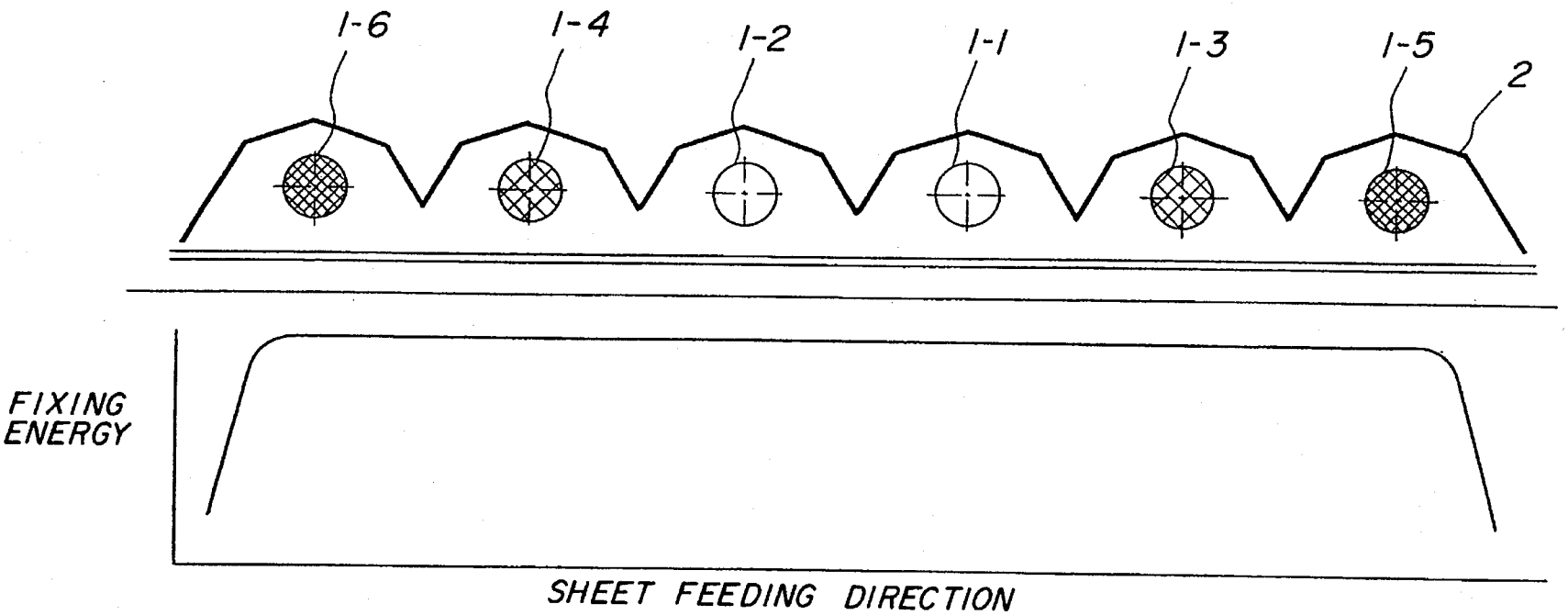
FIG. 10 is an explanatory diagram illustrating a seventh modified example of the present invention.

FIG. 10 is an explanatory diagram showing a seventh modified example according to this invention.

As illustrated in FIG. 10, six pieces of flash lamps 1-1 through 1-6 are arranged in parallel to the sheet. Provided also is the reflection plate 2 for covering these flash lamps 1-1 through 1-6.

The flash lamps 1-1 to 1-6 are respectively provided with unillustrated drive circuits and power supplies. The supply voltage Vs2 of each power supply of the two flash lamps 1-3, 1-4 adjacent to the middle flash lamps 1-1, 1-2 is set higher than the supply voltage Vs1 of each power supply of the middle flash lamps 1-1, 1-2. Further, a supply voltage Vs3 of each power supply of the two flash lamps 1-5, 1-6 at both ends is set higher than the supply voltage Vs2 of each power supply of the adjacent two flash lamps 1-3, 1-4.

Accordingly, the flash lamps 1-5, 1-6 at both ends have the maximum light emitting energy; the flash lamps 1-3, 1-4 adjacent thereto have the intermediate light emitting energy; and the middle flash lamps 1-1, 1-2 have the minimum light emitting energy. The fixing energy distribution of all the flash lamps 1-1 through 1-6 is, as illustrated in FIG. 10, thereby more uniformized. That is, the fixing energy becomes greater at both ends but smaller in the middle than in the prior art.

In this example, the input energy $\epsilon$ of each of the middle flash lamps 1-1, 1-2 is set to 200–400 Joul. Further, the input energy $\epsilon_1$ of each of the two adjacent flash lamps 1-3, 1-4 is set within the range of $\epsilon < \epsilon_1 \leqq 1.3 \times \epsilon$. Moreover, the input energy $\epsilon_2$ of each of the flash lamps 1-5, 1-6 at both ends is set within the range of $\epsilon_1 < \epsilon_2 \leqq 1.3 \times \epsilon_1$.

Therefore, the futile fixing energy in the middle of the flash fixing unit decreases, and, besides, the fixing energies at both ends increase. It is therefore possible to prevent the ill-fixed state at both ends of the flash fixing unit. Further, the futile fixing energy in the middle of the flash fixing unit can be reduced. Accordingly, a fixing ununiformity can be prevented, and, besides, a fixing efficiency can be improved.

Figure 11:
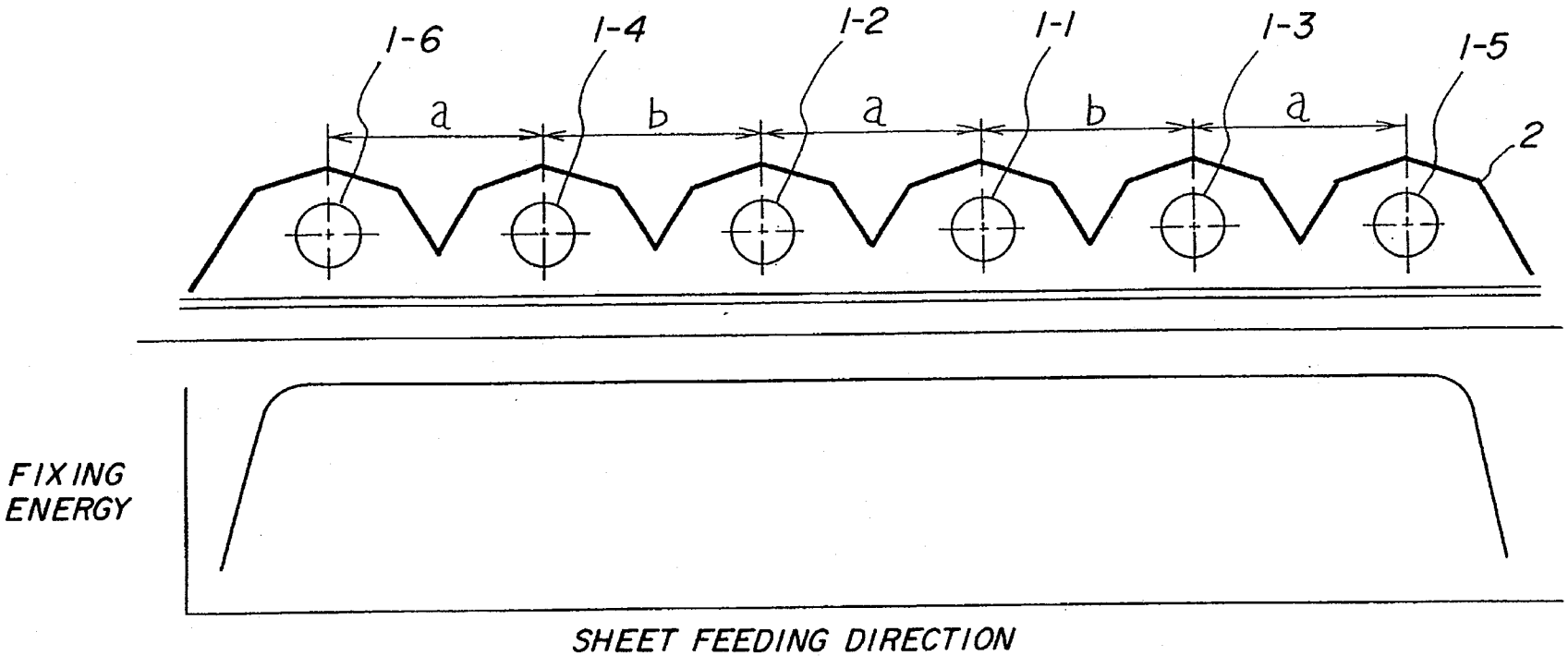
FIG. 11 is an explanatory diagram illustrating an eighth modified example of the present invention.

FIG. 11 is an explanatory diagram showing an eighth modified example of the present invention.

As illustrated in FIG. 11, six pieces of flash lamps 1-1 to 1-6 are arranged in parallel to the sheet. Provided is also the reflection plate 2 for covering these flash lamps 1-1 through 1-6.

The supply voltage inputted to each of the flash lamps 1-1 through 1-6 is fixed. With respect to lamp intervals between the respective flash lamps 1-1 through 1-6, each of lamp intervals b between the two adjacent flash lamps 1-3, 1-1 and between the two adjacent flash lamps 1-2, 1-4 is set smaller than a lamp interval a between the two flash lamps 1-1, 1-2 disposed in the middle. Note that the symbol a represents the lamp intervals between the two adjacent flash lamps 1-3, 1-5 and between the two adjacent flash lamps 1-4, 1-6.

The fixing energies of the adjacent flash lamps 1-3 to 1-6 thereby increase. Accordingly, the fixing energy distribution of all the flash lamps 1-1 through 1-6 is, as illustrated in FIG. 11, thereby more uniformized. That is, the fixing energy becomes greater at both ends but smaller in the middle than in the prior art.

Therefore, the futile fixing energy in the middle of the flash fixing unit decreases, and, besides, the fixing energies at both ends increase. It is therefore possible to prevent the ill-fixed state at both ends of the flash fixing unit. Further, the futile fixing energy in the middle of the flash fixing unit can be reduced. Accordingly, the fixing ununiformity can be prevented, and, besides, the fixing efficiency can be improved.

In this example, the lamp-to-lamp pitch a between the middle flash lamps 1-1, 1-2 is set to 40–50 mm. Further, the lamp-to-lamp pitch b with respect to the flash lamps 1-3 through 1-4 adjacent thereto is set within the range of $a/1.3 \leqq b < a$.

Figure 12:
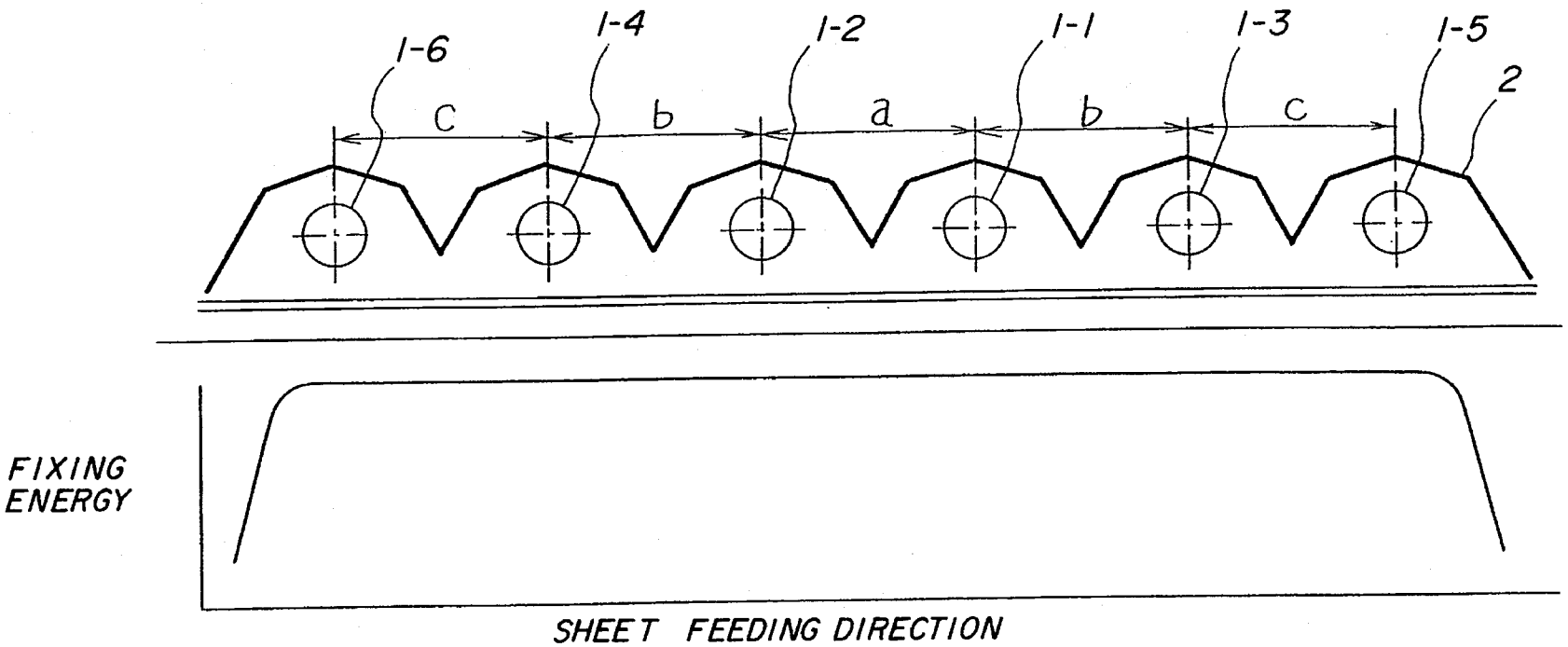
FIG. 12 is an explanatory diagram illustrating a ninth modified example of the present invention.
Figure 13:
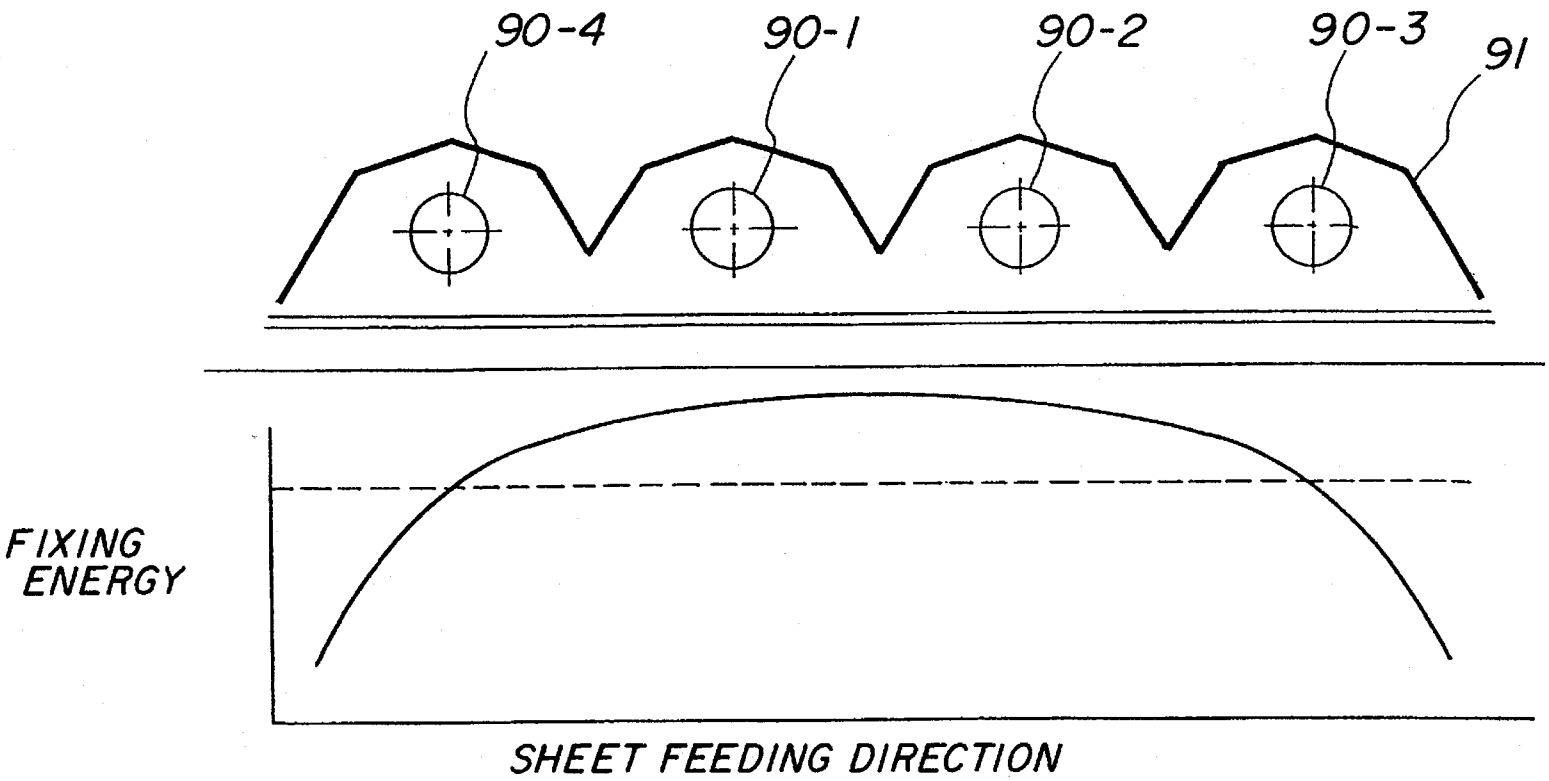
FIG. 13 PRIOR ART
FIG. 13 is an explanatory diagram showing the prior art.

FIG. 12 is an explanatory diagram showing a ninth modified example according to this invention.

As illustrated in FIG. 12, six pieces of flash lamps 1-1 through 1-6 are arranged in parallel to the sheet. Provided also is the reflection plate 2 for covering these flash lamps 1-1 through 1-6.

The supply voltage inputted to each of the flash lamps 1-1 through 1-6 is fixed. Each of the lamp-to-lamp pitches b between the two middle flash lamps 1-1, 1-2 and the flash lamps 1-3, 1-4 adjacent thereto is set smaller than the lamp-to-lamp pitch a between the middle flash lamps 1-1, 1-2. Furthermore, each of lamp-to-lamp pitches c with respect to the two flash lamps 1-5, 1-6 at both ends is set smaller than the lamp-to-lamp pitch b with respect to the flash lamps 1-3, 1-4 adjacent thereto.

Accordingly, the fixing energy distribution of all the flash lamps 1-1 through 1-6 is, as illustrated in FIG. 12, thereby more uniformized. That is, the fixing energy becomes greater at both ends but smaller in the middle than in the prior art.

Therefore, the futile fixing energy in the middle of the flash fixing unit decreases, and, besides, the fixing energies at both ends increase. It is therefore possible to prevent the ill-fixed state at both ends of the flash fixing unit. Further, the futile fixing energy in the middle of the flash fixing unit can be reduced. Accordingly, the fixing ununiformity can be prevented, and, besides, the fixing efficiency can be improved.

In this example, the lamp-to-lamp pitch a between the middle flash lamps 1-1, 1-2 is set to 40–50 mm. Further, each of the lamp-to-lamp pitches b with respect to the flash lamps 1-3, 1-4 adjacent thereto is set to $a/1.3 \leqq b < a$. Moreover, the lamp-to-lamp pitch c with respect to the flash lamps 1-5, 1-6 at both ends is set within a range of $1.3b \leqq c < b$.

In addition to the embodiments discussed above, the present invention is modifiable as follows. First, the number of the flash lamps can be properly selected based on a fixing area at one time corresponding to a feed velocity of the sheet. Second, the image forming apparatus has been explained in the form of a printer but is applicable to a copying machine.

The present invention has been discussed above by way of the embodiments. A variety of modifications can be carried out within the range of the gist of the present invention, and these modifications are not excluded from the scope of the present invention.

As discussed above, according to the present invention, the fixing energies are changed between the central flash lamps and the flash lamps at both ends, and the fixing energy distribution can be therefore uniformized. For this reason, it is feasible to prevent the fixing ununiformity and enhance the fixing efficiency.

What is claimed is:

1. An image forming apparatus for forming an image on a sheet, comprising:

means for forming a toner image on the sheet; and flash fixing means for fixing the toner image onto the sheet by an emission of light from a flash lamp, said flash fixing means including:

first means having a first flash lamp disposed at the center; and second means having second flash lamps disposed on both sides of said first flash lamp and exhibiting a light emitting energy larger than a light emitting energy of said first means.

2. An image forming apparatus according to claim 1, wherein said first means has said first flash lamp and a first energy source for supplying the input energy to said first flash lamp, and said second means has said second flash lamp and a second energy source for supplying said second flash lamp with the input energy larger than the input energy of said first energy source.

3. An image forming apparatus according to claim 2, wherein said first energy source includes means for supplying a first voltage to said first flash lamp, and said second energy source includes means for supplying a second voltage higher than the first voltage.

4. An image forming apparatus according to claim 2, wherein said second energy source supplies an input energy that is exceeds once but equal to or less than 1.3 times the input energy of said first energy source.

5. An image forming apparatus according to claim 1, wherein said flash fixing means further includes third means having a third flash lamp provided outwardly of said second flash lamp and exhibiting a light emitting energy larger than the light emitting energy of said second means.

6. An image forming apparatus according to claim 1, wherein said means for forming the toner image forms the toner image on the sheet while feeding the consecutive sheet, and said flash fixing means performs fixing on the sheet to be fed.

7. An image forming apparatus for forming an image on a sheet, comprising:

means for forming a toner image on the sheet; and flash fixing means for fixing the toner image onto the sheet by an emission of light from a flash lamp, said flash fixing means including:

first means having first flash lamps disposed at the center and at a predetermined pitch between said first flash lamps; and second means having second flash lamps disposed on both sides of said first flash lamps and at a pitch smaller than the pitch at which said first lamps are disposed.

8. An image forming apparatus according to claim 7, wherein said flash fixing means includes third means having third flash lamps provided outwardly of said second flash lamp and disposed at a pitch smaller than the pitch of said second flash lamps.

9. An image forming apparatus according to claim 7, wherein said second flash lamps are disposed at a pitch that is equal to or larger than 1.3 times but does not exceed once the pitch of said first flash lamp.

* * * * *